United States Patent [19]

Fleck et al.

[11] 4,169,702

[45] Oct. 2, 1979

[54] IMPROVED OPTICAL BRIGHTENING OF POLYAMIDES

[75] Inventors: Fritz Fleck, Bottmingen, Switzerland; Emmanuel Hervot, Bonnieres, France; Peter Merk, Muttenz, Switzerland; Horst Schmid, Reinach, Switzerland; Achim Wiedemann, Weil-am-Rhein, Fed. Rep. of Germany

[73] Assignee: Sandoz Ltd., Basel, Switzerland

[21] Appl. No.: 766,410

[22] Filed: Feb. 7, 1977

[30] Foreign Application Priority Data

Feb. 10, 1976 [CH] Switzerland ..... 1610/76

[51] Int. Cl.[2] ..... D06P 1/645

[52] U.S. Cl. ..... 8/1 W; 8/85 R; 8/86; 8/88; 8/93; 8/168 B; 8/172 R; 8/176; 8/178 R; 252/301.21

[58] Field of Search ..... 8/1 W, 168 B, 172 R, 8/85 R, 86, 88

[56] References Cited

FOREIGN PATENT DOCUMENTS 6723124 11/1967 Japan .
7110871 3/1971 Japan .
7341707 12/1973 Japan .
7401036 1/1974 Japan .
1256660 12/1971 United Kingdom .

OTHER PUBLICATIONS

Venkataraman, K., "The Chemistry of Synthetic Dyes" vol. V, Academic Press, New York, 1971, pp. 536, 663–664.

*Primary Examiner*—A. Lionel Clingman
*Attorney, Agent, or Firm*—Gerald D. Sharkin; Richard E. Vila; Thomas C. Doyle

[57] ABSTRACT

Disclosed is an optical brightening process for substrates comprising or consisting of synthetic polyamide in which the optical brightener is applied to the substrate by impregnation followed by heat treatment and wherein the brightener is applied in the presence of a compound or mixture of compounds of formula I, $$RNH_2 \qquad \text{I}$$

wherein R is —OH, —$NR_1R_2$ or $$-NH\overset{\overset{X}{\|}}{C}-NHR_1$$

X being O, S or NH, and $R_1$ and $R_2$ being, independently, hydrogen, $C_{1-6}$alkyl or $C_{2-4}$hydroxyalkyl, which compounds are in free base or acid addition salt form or, when R is OH, in O-sulphonic acid form, and preparations for use in such process.

26 Claims, No Drawings

IMPROVED OPTICAL BRIGHTENING OF POLYAMIDES

The present invention relates to an optical brightening process.

According to the invention there is provided an optical brightening process for substrates comprising or consisting of synthetic polyamide in which the optical brightener is applied to the substrate by impregnation followed by heat treatment and wherein the brightener is applied in the presence of a compound or mixture of compounds of formula I, $$RNH_2 \qquad \text{I}$$

wherein

R is —OH, $—NR_1R_2$ or $$—NH\overset{\overset{X}{\|}}{C}—NHR_1$$

X being O, S or NH, and $R_1$ and $R_2$ being, independently, hydrogen, $C_{1-6}$alkyl or $C_{2-4}$hydroxyalkyl, which compounds are in free base or acid addition salt form or, when R is OH, in O-sulphonic acid form.

In the compounds of formula I, R is preferably —OH or $—NR_1R_2$.

Where, in the compounds of formula I, $R_1$ and/or $R_2$ are $C_{1-6}$alkyl, such alkyl is preferably of 1 to 4, more preferably of 1 or 2, carbon atoms. The preferred hydroxyalkyl radicals as $R_1$ and/or $R_2$ are $\beta$-hydroxyethyl and $\beta$-hydroxypropyl. Preferably, however, $R_1$ and $R_2$ are hydrogen. Thus, most preferably, R is —OH or $—NH_2$.

The compounds of formula I are preferably in acid addition salt form or, when R is —OH, in O-sulphonic acid form, the acid addition salt forms being particularly preferred.

In any acid addition salt form, the acid involved is preferably one commonly used for the production of acid addition salt forms of amines, e.g. mineral acids such as sulphuric acid, phosphoric acid and hydrochloric acid, organic carboxylic acids such as acetic acid, formic acid and benzoic acid, and organic sulphonic acids, such as paratoluene sulphonic acid, the most preferred acids being sulphuric, phosphoric, hydrochloric and acetic acids.

Representative of the compounds of formula I may be given hydroxylamine, hydroxylamine hydrogen sulphate, hydroxylamine sulphate, hydroxylamine hydrochloride, hydroxylamine-O-sulphonic acid, hydroxylammonium acetate, hydrazine, hydrazine sulphate, hydrazine hydrochloride, semicarbazide and semicarbazide hydrochloride.

Where acid conditions are employed in the brightening process, and a compound of formula I in free base form is employed, it will be converted into acid addition salt form.

In the process of the invention, the substrate may be impregnated with an optical brightening liquor in conventional manner to the desired pick-up, for example at a temperature of from 10° to 40° C., preferably at 15° to 30° C. The padding method is preferred. The subsequent heat treatment may also be carried out in conventional manner, the elevated temperature being such as to fix the brightener and, optionally, also to fix the fibres when the substrate is textile in nature. A temperature of at least 95° C. is preferably employed. The heat treatment may, for example, be according to the 'acid shock' method, i.e. fixation in acid medium at about boiling temperature, by use of saturated, particularly, superheated, steam treatment or by dry heat treatment, the thermosol method being of particular interest. The process of the invention is particularly suited to continuous brightening techniques, espcially the thermosol process, by which very economical and good brightenings can be obtained.

The synthetic polyamide may be any conventional in the textile industry, especially polyamide 11, 6.6 and 6, and may be in any conventional form, e.g. fibre, filament, thread, fabric, web, fleece, woven, non-woven or carpet form.

Conventional amounts of optical brightener may be employed in the process of the invention, e.g. in the range of 0.001% to 5%, preferably 0.01 to 2%, based on the weight of the substrate, the optimum amount depending, of course, on the particular brightener and process conditions.

The amount of compound of formula I employed, based on the amount of brightener, can vary within wide limits but is generally in the range of 0.1 to 20 parts by weight for each part by weight of brightener, advantageously from 0.15 to 10 and preferably from 0.2 to 5 parts per part of brightener.

The compound of formula I is preferably contained in the brightener containing impregnation liquor, advantageously at a concentration of from 0.1 to 40 g/l, preferably from 1 to 10 g/l and especially from 3 to 7 g/l, the last range being particularly preferred where a liquor pick-up, based on the dry weight of the substrate, is from 80 to 100%.

Based on the weight of the substrate, the compound of formula I is generally employed in an amount of at least 0.01%, advantageously from 0.01 to 2%, preferably from 0.1 to 1% and especially from 0.3 to 0.7%.

In a preferred embodiment of the invention, the substrate is impregnated with a liquor containing the optical brightener and the compound(s) of formula I, the pH of the liquor being controlled on the acid side, advantageously from 2.5 to 5, preferably between 3 and 4, and most preferably from 3 to 3.5, e.g. by addition of an acid or acid liberating agent, as is conventional in synthetic polyamide treatment. Fixation takes place, for example, by saturated steam treatment, e.g. at 100° to 102° C., by superheated steam treatment, e.g. at 120° to 140° C. or, preferably, by dry heat treatment, e.g. between 140° and 200° C., preferably between 150° and 180° C., depending on the nature of the substrate. The thus treated substrate can then, in usual manner, be rinsed and dried.

As regards the optical brightener employed in the process of the invention, any brightener employable for synthetic polyamide may be used, whether water soluble or not. Thus, so-called "polyamide brighteners" and "universal brighteners" may be used, but those free from strongly basic groups or s-triazine bound primary, secondary or tertiary amine groups are preferred. More preferably are brighteners of the stilbene, styryl, pyrazoline or triazole series employed and particularly the brighteners known from the following literature: German Patent Specification Nos. 2,145,019; 2,011,552; 2,142,564; 1,279,636; 1,619,046; 2,248,820; 2,524,927; 2,345,159; 2,212,480; 2,423,091 and 2,534,185, French Patent Specification Nos. 1,576,018; 1,583,595 and 1,354,629, German Patents 923,267 and 1,080,963, Belgian Patents 721,754 and 666,139, Dutch Patent Application No. 6605212, U.S. Patent No. 1,108,416 and U.K. Patent 712,764. Particularly good results have been attained with brighteners of the naphthotriazolyl-(2)-stilbene series containing sulpho groups and of the 1,3-diphenylpyrazoline series, those of the latter series in which the 1-phenyl group is substituted by an acyl group, the 3-phenyl radical is optionally substituted by chlorine and/or methyl and the pyrazoline radical optionally further substituted by conventional substituents, being of especial interest.

As representatives of further preferred brighteners for use in the process of the invention may be given the compounds of the following formulae

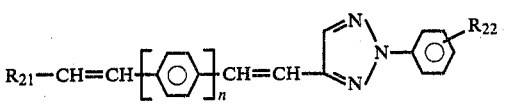

(a)

where $R_{21}$ is a radical

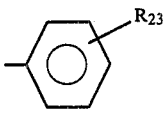

or

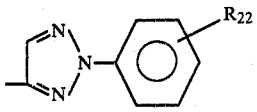

$R_{22}$ is hydrogen or $—SO_3M$, $R_{23}$ is hydrogen, chlorine or $—SO_3M$, and n is 1 or 2;

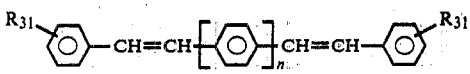

(b)

where each $R_{31}$, independently, is hydrogen, $—SO_3M$ or $C_{1-4}alkyl—SO_2—$, n being as defined above, the compounds preferably being symmetrical,

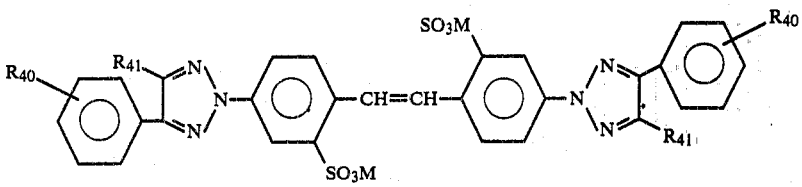

(c)

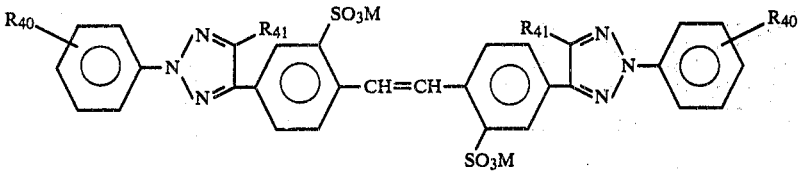

(d)

and

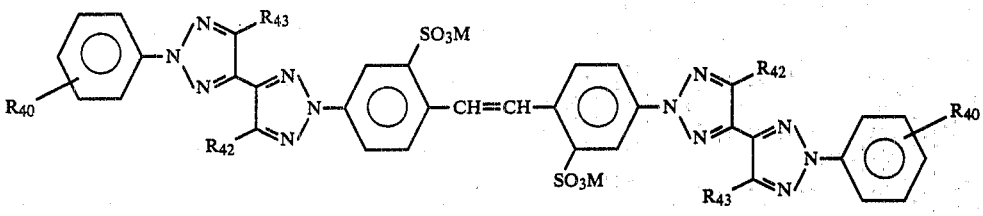

(e)

where the $R_{40}$'s are the same and hydrogen or $—SO_3M$, the $R_{41}$'s are the same and hydrogen, methyl or chlorine, and $R_{42}$ and $R_{43}$, independently, are hydrogen or methyl, the compounds of formulae (c), (d) and (e) preferably being symmetrical.

M in the above formulae is hydrogen or a non-chromophoric cation, the preferred non-chromophoric cations being alkali-metal cations and optionally substituted ammonium cations, e.g. mono-, di- or tri-$(C_{1-4})$-alkylammonium and mono-, di- and tri-$(C_{2-4})$-alkanolammonium cations, as well as the ammonium cation itself, the most preferred cation being the sodium cation.

The particularly preferred brighteners for use in the process of the invention are the following

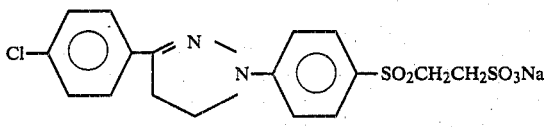

(i)

-continued (ii)

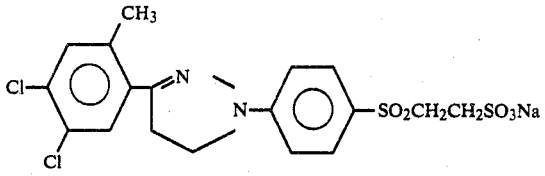

(iii)

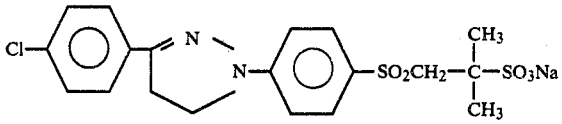

(iv)

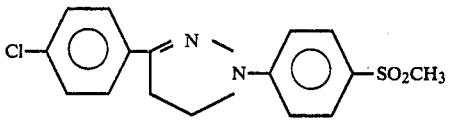

(v)

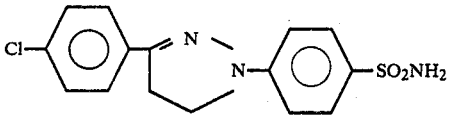

(vi)

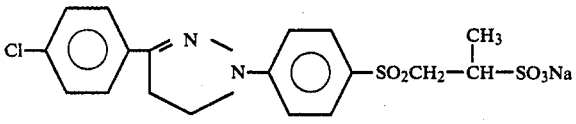

(vii)

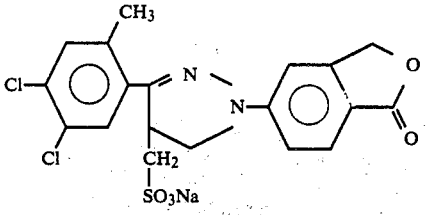

(viii)

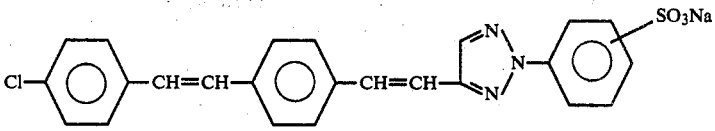

(ix)

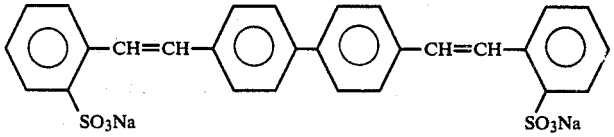

(x)

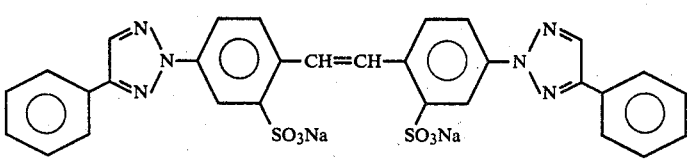

and (xi)

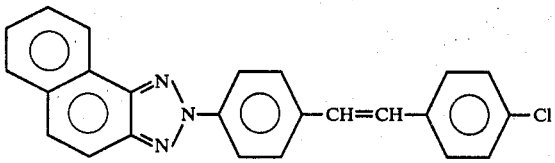

In the case of anionic optical brighteners which conventionally contain salts, such as sodium carbonate, chloride or sulphate, the salt content thereof is preferably low for use in the present invention, e.g. of the order of 0 to 20%, preferably 0 to 10%, based on the weight of the brightener. The anionic brighteners are preferred in the process of the invention.

Additional to the compound(s) of formula I and brightening agent, the impregnation liquor may contain further additives conventional in brightening processes for synthetic polyamide. Thus, amides conventionally used, particularly urea, may be contained therein. The amount of such amide can vary within wide limits, for example from 0 to 100 parts per part of brightener. Generally, however, the amount would be 0 to 20, preferably 0.2 to 10 and most preferably from 0.3 to 7 parts per part of brightener. Also, polyglycolethers, again as conventionally used in brightening synthetic polyamides, may be contained therein. Such ethers preferably have a molecular weight of 200 to 1200, more preferably from 300 to 600 and are preferably polyalkyleneglycolethers and condensation products of alkylene oxides such as ethylene-, propylene- or butylene-oxide with alcohols, thioalcohols, and optionally alkyl substituted phenols or thiophenols, or mixtures thereof. Of these condensation products the oxy compounds are preferred to the thio compounds and the alkyl substituted phenol derivatives to the unsubstituted phenols. The preferred alkylene oxide from which the glycols are derived is ethylene oxide, the preferred alcohols and thio-alcohols are those containing 8 to 18 carbon atoms and the preferred phenols and thio phenols are those bearing one or two $C_{4-9}$alkyl substituents. The polyalkylene glycols which are condensation products with alcohols or thio-alcohols preferably contain 5 to 18 mols, more preferably 10 mols, of alkylene oxide per mol of alcohol or thio-alcohol and those which are condensation products with phenols and thio-phenols preferably contain 4 to 20, more preferably 8 to 10 mols of alkylene oxide. As examples of such condensation products may be given iso-octyl—O—$(C_2H_4O)_pH$, 2-ethylhexyl—O—$(C_2H_4O)_p$—H, 3,5,5-trimethylhexyl-O—$C_2H_4O$—$_pH$, lauryl—O—$(C_2H_4O)_pH$, where p is 5 to 10, n-$C_{13}H_{27}$—O—$(C_2H_4O)_5H$, iso-$C_{13}H_{27}$—O—$(C_2H_4O)_8H$, stearyl-O—$(C_2H_4O)_5H$, aleyl-O—$(C_2H_4O)_5H$, mono- or dinonylphenyl-O—$(C_2H_4O)_mH$, mono- or di-iso-octylphenol-O—$(C_2H_4O)_mH$, 2,4-di-tert.-amyl-phenyl—O—$(C_2H_4O)_mH$ and 2,4-di-tert-.—butylphenyl—O—$(C_2H_4O)_mH$, where m is 8 to 12, preferably preferably 10.

As indicated above, the polyglycolether can be a pure product or a mixture of products. Thus, for example, a 100% polyalkylene glycol, e.g. polyethylene glycol can be used or a mixture of polyethylene glycol and an alcoholpolyglycolether and/or alkylphenolpolyglycolether. Indeed, mixtures are preferred, particularly such mixtures containing 60 to 85% of polyethylene glycol or other polyalkylene glycol and 15 to 40% of a condensation product as described above. The amount of the condensation product is, however, generally lower, e.g. of the order of 10 to 20%, if further liquor additives, such as anti-foaming agents, which are generally esters, e.g. organic esters such as benzoic acid, benzyl ester and alkanecarboxylic acid esters such as acetic acid butyl ester or 2-ethyl caproic acid-2'-ethylbutyl ester, as well as esters of inorganic acids, such as tri-isobutyl phosphate, are present. Where an anti-foaming agent is present in the liquor, it is generally present in an amount of up to 25%, preferably 5 to 10% based on the weight of the polyglycolether.

Where a polyglycol ether is present it is generally present in an amount of from 0.2 to 40, preferably 0.5 to 25, and more preferably 2 to 10 parts per part of brightener.

Preferred liquors for use in the process of the invention have the following amounts by weight of compound of formula I, polyglycol ether and urea:

2–10, preferably 2–8 parts by weight of a compound of formula I,

0–35, preferably 10–35 parts by weight of polyglycol ether or mixture thereof, and 0–20, advantageously 1–20, preferably 1.3–14 parts by weight of urea.

The invention also provides solid and especially liquid preparations from which the preferred impregnation liquors for use in the process of the present invention can be readily prepared. Such liquid preparations preferably contain the optical brightener, a compound of formula I, a polyglycol ether or mixture of polyglycol ethers (optionally containing an anti-foaming agent) and, optionally, an amide such as urea. Generally such liquid preparations are of the following composition:

0.1–10, preferably 0.2–5, parts by weight of optical brightener, 0.1–10, preferably 0.1–2, parts by weight of a compound of formula I, 0.0–10, preferably 0.1–2, parts by weight of urea, 0.2–25, preferably 0.6–12, parts by weight of a polyglycol ether or polyglycol ether mixtures, optionally containing an anti-foaming agent, up to 50, preferably 0.9–20 parts by weight of water.

Typically, however, the liquid preparations have the following composition:

$X_1$=1 part by weight optical brightener, $X_2$=0.1–20 parts by weight of a compound of formula I, $X_3$=0–20 parts by weight urea, $X_4$=0.2–40 parts by weight polyglycol ether or mixture thereof, optionally containing an anti-foaming agent, and $X_5$=Y parts by weight of water to form a stable dispersion or solution, the amount preferably being the minimum required.

In the above preparations $X_2$ is preferably $X_2'$, i.e. 0.15–10, more preferably $X_2''$, i.e. 0.2–5. $X_3$ is preferably $X_3'$, i.e. 0.5–25, more preferably $X_3''$, i.e. 0.3–7. $X_4$ is preferably $X_4'$, i.e. 0.5–25, more preferably $X_4''$, i.e. 2–10. Thus, the preferred preparations are made up of $X_1+X_2'+X_3'+X_4'+X_5$ and the most preferred preparations are made up of $X_1+X_2''+X_3''+X_4''+X_5$.

Other liquid preparations include the following types:

(a) containing optical brighteners+compound of formula I+water+optionally, urea, (b) containing optical brightener+polyglycolether+water+optionally, urea, and (c) containing compound of formula I+polyglycolether+water+optionally, urea.

In type (a) above, a typical composition would be $X_1+X_2+X_3+X_5$, preferably $X_1+X_2'+X_3'+X_5$, more preferably $X_1+X_2''+X_3''+X_5$. In preparing the impregnation bath from such preparation, it would be preferred to add a polyglycolether as described above.

In type (b) above, a typical composition would be $X_1+X_3+X_4+X_5$, preferably $X_1+X_3'+X_4'+X_5$, more preferably $X_1+X_3''+X_4''+X_5$. The preparation may, for example, be a dispersion but is preferably a true solution. The preferred polyglycolether for such a preparation is a mixture of 60–85% polyethyleneglycol and 15–40% of an alcohol-or, preferably, alkylphenolpolyglycolether, e.g. as described above. In preparing an impregnation liquor for use in the present invention, a compound of formula I would be used.

In type (c) above, a typical composition would be $X_2+X_3+X_4+X_5$, preferably $X_2'+X_3'+X_4'+X_5$, more preferably $X_2''+X_3''+X_4''+X_5$. The preferred preparations of this type are true solutions. In preparing an impregnation liquor from such a preparation, an optical brightener would be added.

The liquid preparations, if desired, may contain further additives, such as acids for pH control of the impregnation liquor or dispersing agents where non or only slightly water soluble brighteners are employed.

The solid preparations comprise optical brightener+compound of formula I+optionally urea, and generally have the following composition:

0.1–10 parts by weight optical brightener, 2–10, preferably 2–8 parts by weight of a compound of formula I, 0–25, preferably 1–20, more preferably 1.3–14 parts by weight urea.

Typical solid preparations are made up of $X_1+X_2+X_3$, preferably $X_1+X_2'+X_3'$ and more preferably $X_1+X_2''+X_3''$. The preparations may, for example, be in powder or granulate form.

From the above solid preparations, liquors can be made up by addition of water and other desired additives, for use in the process of the invention.

By the process of the invention an increase in the brightening effect of the brighteners is obtained, arising from the use of the compounds of formula I, which increase is further improved by the presence of the polyglycol ether and/or urea.

The invention is illustrated by the following Examples.

EXAMPLE 1

A polyamide-6.6 fabric ("Nyltest") is impregnated at room temperature to 100% dry weight pick-up in an aqueous bath containing 1.8 g/l optical brightener of formula (iii)
25.5 g/l polyethylene glycol (MW 400)
3.0 g/l n-$C_{13}H_{27}$—O—$(C_2H_4O)_5$H
0.75 g/l 2-ethylcaproic acid-2'-ethylbutyl ester
0.75 g/l tri-isobutyl phosphate
5.0 g/l hydroxylamine sulphate
0.5 g/l tartaric acid
2.0 g/l monosodium phosphate then it is dried for 30 seconds at 140° C. and subsequently subjected to thermo-fixation for 30 seconds at 180° C. The polyamide fabric thus treated is optically brightened to a strong degree.

Very good whitening effects are also obtained by proceeding as above, but using 1.08 g/l of a compound of formula (iv) in place of the compound of formula (iii) or by employing 5.0 g/l hydrazine sulphate or semi-carbazide hydrochloride in place of the hydroxylamine sulphate.

EXAMPLE 2

A polyamide 6.6 fabric ("Nyltest") is impregnated at room temperature to 100% dry weight pick-up in an aqueous bath containing 2.8 g/l optical brightener of formula (ii)
20 g/l polyethylene glycol (MW 400)
2.5 g/l n-$C_{13}H_{27}$—O—$(C_2H_4O)_5$H
0.6 g/l 2-ethylcaproic acid-2'-ethylbutyl ester
0.6 g/l tri-isobutyl phosphate
1 g/l sodium sulphate
5 g/l hydroxylamine sulphate and
6.2 g/l urea and whose pH value has been set at 3 by using a conventional acid yielding agent. It is then dried for 30 seconds at 140° C. and subsequently subjected to thermofixation for 30 seconds at 180° C.

EXAMPLE 3

(liquid preparation)

A stable, concentrated brightener preparation is obtained by mixing the following components homogenously:

10 parts by weight of the optical brightener of formula (i)
5 parts by weight of urea
5 parts by weight of hydroxylamine sulphate ($2NH_2OH.H_2SO_4$)
25 parts by weight of polyethylene glycol (MW 400)
4 parts by weight of n-tridecanol pentaethylene glycol ether
1 part by weight of tri-isobutyl phosphate and
50 parts by weight of demineralised water.

Concentrated, stable brightener preparations are similarly obtained by replacing the 10 parts by weight of the optical brightener of formula (i) by the same amount of an optical brightener containing sulpho groups which is of formula (ii), (iii), (vi), (vii), (viii), (ix), (x) or (xi).

EXAMPLE 4

(solid preparation)

A solid brightener preparation is obtained by mixing together or grinding the following components 30 parts by weight of the optical brightener of formula (vi)
5 parts by weight of hydroxylamine sulphate
5 parts by weight of $Na_2SO_4$ and
50 parts by weight of urea, or by atomising a corresponding aqueous solution.

Solid brightener preparations are similarly obtained by using instead of the 30 parts of the optical brightener of formula (vi), the same amount of one of the optical brighteners of formula (i) to (iii), (vii), (viii), (ix), (x) or (xi).

EXAMPLE 5

A polyamide 6.6 fabric ("Nyltest") is impregnated at room temperature to 100% dry weight pick-up in an aqueous bath containing 1.0 g/l optical brightener of formula (ix)
20.0 g/l polyethylene glycol (MW 400)
2.5 g/l n-$C_{13}H_{27}$—O—$(C_2H_4O)_5$H
0.6 g/l 2-ethylcaproic acid-2'-ethylbutylester
0.6 g/l tri-isobutyl phosphate
5.0 g/l hydrazine sulphate and
6.2 g/l urea, the pH of which has been set at 3 by addition of a conventional acid liberating agent. The fabric is then dried at 140° C. for 30 seconds and then fixed for 30 seconds at 180° C. A good whitening effect results.

Similar results are obtained using 5 g/l semi-carbazide hydrochloride or hydroxylamine sulphate in place of the hydrazine sulphate.

The following preparations according to the invention may be employed in the preparation of impregnating liquors for use in the process of the invention.

PREPARATION 1

(particularly suitable for low brightening concentration baths, e.g. 2–11 g/l brightener+urea)

0.66 parts by weight optical brightener
1.32 parts by weight urea and

2–5 parts by weight of a compound of formula I.

In the use of such a preparation, 10 to 17 parts by weight of polyglycolether or polyglycolether mixture are advantageously added.

PREPARATION 2

(particularly suitable for high brightener concentration baths, e.g. 11–20 g/l brightener+urea)

6.6 parts by weight optical brightener
13.2 parts by weight urea and
5–8 parts by weight of a compound of formula I.

In the use of such a preparation, 30 to 35 parts by weight of polyglycolether or polyglycolether mixture are advantageously added.

PREPARATION 3

3.6 parts by weight optical brightener
7.3 parts by weight urea and
5.0 parts by weight of a compound of formula I.

In the use of such a preparation, 20 to 25 parts by weight of polyglycolether or polyglycolether mixture are advantageously added.

PREPARATION 4

(liquid preparation)

2.4 parts by weight optical brightener
1.0 part by weight urea
1.0 part by weight of a compound of formula I,
6.0 parts by weight of polyglycolether or mixture and
9.0 parts by weight water.

PREPARATION 5

(liquid preparation)

12.0 parts by weight optical brightener, e.g. formula (iii)
5.0 parts by weight urea
5.0 parts by weight hydroxylamine sulphate
25.5 parts by weight polyethyleneglycol (mol wt. 400)
1.5 parts by weight isononylphenoldecaglycolether
1.5 parts by weight benzoic acid benzyl ester
49.5 parts by weight water.

What is claimed is:

1. In a process wherein a substrate comprising fibre, filament, thread, web, fleece or woven or non-woven fabric of synthetic polyamide is impregnated with a liquor containing an optical brightener and thereafter treated with steam or with dry heat, the temperature of the steam or dry heat treatment being at least 95° C., the improvement wherein the brightener is applied in the presence of a compound or mixture of compounds of formula I, $$RNH_2 \qquad \text{I}$$

wherein

R is —OH, $—NR_1R_2$ or $$—NH\overset{\overset{X}{\|}}{C}—NHR_1$$

X being O, S or NH, and $R_1$ and $R_2$ being, independently, hydrogen, $C_{1-6}$alkyl or $C_{2-4}$hydroxyalkyl, which compounds are in free base or acid addition salt form or, when R is OH, in O-sulphonic acid form.

2. A process according to claim 1 wherein the substrate is padded with the liquor containing the optical brightener and a polyglycolether and treated with dry heat at 140° to 200° C.

3. A process according to claim 2, wherein the compound of formula I is hydroxylamine, hydroxylamine hydrogen sulphate, hydroxylamine sulphate, hydroxylamine hydrochloride, hydroxylamine-O-sulphonic acid, hydroxylammonium acetate, hydrazine, hydrazine sulphate, hydrazine hydrochloride, semicarbazide or semicarbazide hydrochloride.

4. A process according to claim 3, wherein the compound of formula I is hydroxylamine hydrogen sulphate, hydroxylamine sulphate, hydroxylamine hydrochloride, hydroxylammonium acetate, hydrazine sulphate or hydrazine hydrochloride.

5. A process according to claim 1 wherein the compound of formula I is present in a liquor containing the optical brightener at a temperature of 10° to 40° C.

6. A process according to claim 2 wherein the liquor has a pH of 2.5 to 5; the polyglycolether is present in an amount of from 0.2 to 40 parts per part of brightener, has a molecular weight of 200 to 1200 and is a polyalkylene glycolether or a condensation product of an alkylene oxide with an alcohol, thioalcohol or optionally alkyl-substituted phenol or thiophenol or a mixture of said ether with one or more of said condensation products; and the compound of formula I is present in an amount of from 0.15 to 10 parts by weight per part of optical brightener and is hydroxylamine, hydroxylamine hydrogen sulphate, hydroxylamine sulphate, hydroxylamine hydrochloride, hydroxylamine-O-sulphonic acid, hydroxylammonium acetate, hydrazine, hydrazine sulphate, hydrazine hydrochloride, semicarbazide or semicarbazide hydrochloride.

7. A process according to claim 1, wherein, in the compound of formula I, R is —OH or $—NR_1R_2$.

8. A process according to claim 1, wherein the compound of formula I is an acid addition salt form or, where R is —OH, in O-sulphonic acid form.

9. A process according to claim 1, wherein the compound of formula I is hydroxylamine, hydroxylamine hydrogen sulphate, hydroxylamine sulphate, hydroxylamine hydrochloride, hydroxylamine-O-sulphonic acid, hydroxylammonium acetate, hydrazine, hydrazine sulphate, hydrazine hydrochloride, semicarbazide or semicarbazide hydrochloride.

10. A process according to claim 9, wherein the compound of formula I is hydroxylamine hydrogen sulphate, hydroxylamine sulphate, hydroxylamine hydrochloride, hydroxylammonium acetate, hydrazine sulphate or hydrazine hydrochloride.

11. A process according to claim 1, wherein the amount of compound of formula I employed is from 0.1 to 20 parts per part of brightener.

12. A process according to claim 11, wherein said amount is from 0.15 to 10 parts.

13. A process according to claim 1, wherein the compound of formula I is contained in an optical brightener-containing impregnation liquor, the concentration of said compound in said liquor being from 0.1 to 40 g/l and said optical brightener being anionic.

14. A process according to claim 13, wherein said concentration is from 1 to 10 g/l.

15. A process according to claim 1, wherein the compound of formula I is employed in an amount of at least 0.01% based on the weight of the substrate.

16. A process according to claim 15, wherein said amount is from 0.01 to 2%.
17. A process according to claim 5, wherein the pH of the impregnation liquor is on the acid side.
18. A process according to claim 17, wherein said pH is from 2.5 to 5.
19. A process according to claim 1, wherein the optical brightener is selected from the following
(i)
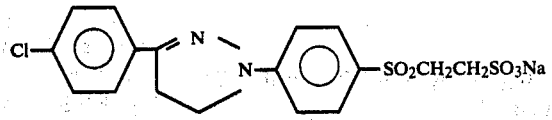
(ii)
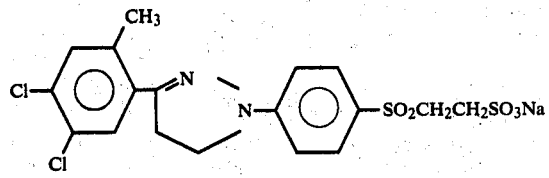
(iii)
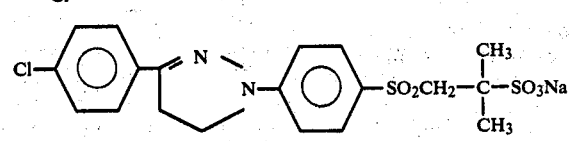
(iv)
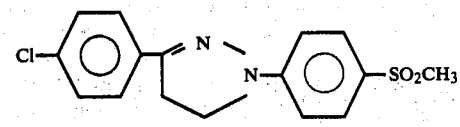
(v)
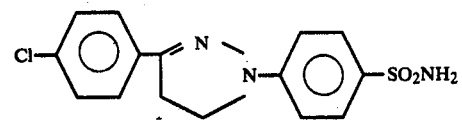
(vi)
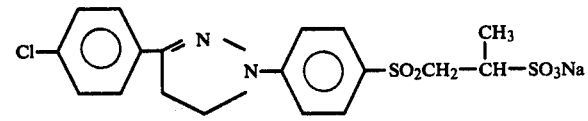
(vii)
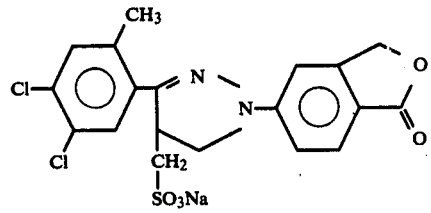
(viii)
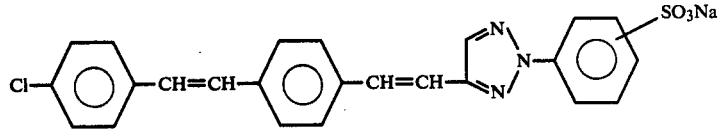
(ix)
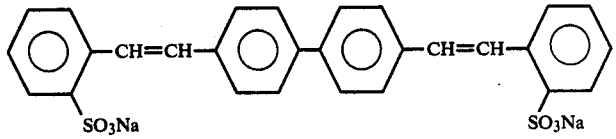
(x)
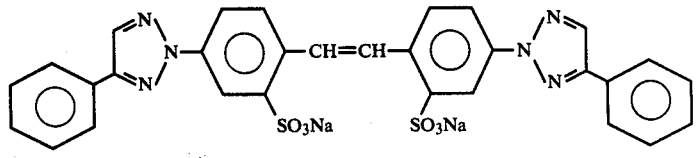
and -continued (xi)

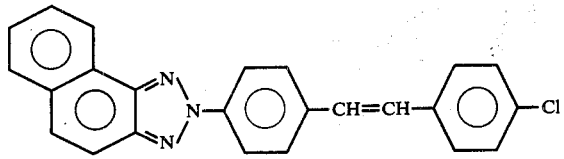

20. A process according to claim 1, wherein the impregnation liquor contains urea.

21. A process according to claim 20, wherein the amount of urea employed is up to 100 parts per part of brightener.

22. A process according to claim 1, wherein the impregnation liquor of (a) contains a polyglycolether.

23. A process according to claim 22, wherein the polyglycolether of (a) or (b) is a polyalkylene glycolether or a condensation product of an alkylene oxide with an alcohol, thioalcohol or optionally alkyl substituted phenol or thiophenol or a mixture of said ether with one or more of said condensation products.

24. A process according to claim 23, wherein said polyglycolether is a mixture of 60 to 80% by weight polyalkyleneglycolether and 15 to 40% by weight of one or more of said condensation products.

25. A process according to claim 22, wherein said polyglycolether is present in an amount of from 0.2 to 40 parts per part of brightener.

26. A liquid preparation for use in the process of claim 1 containing 0.1 to 10 parts by weight optical brightener, 0.1 to 10 parts by weight of a compound of formula I, as defined in claim 1, 0 to 10 parts by weight of urea, 0.2 to 10 parts by weight of a polyglycolether and up to 50 parts by weight water; or 1 part by weight optical brightener, 0.1 to 20 parts by weight of a compound of formula I, stated in claim 1, 0 to 20 parts by weight urea, 0.2 to 40 parts by weight polyglycolether and water in an amount sufficient to form a stable dispersion or solution; or 1 part by weight of optical brightener, 0 to 20 parts by weight of urea, 0.2 to 40 parts by weight of a mixture of 60 to 85% by weight polyalkyleneglycolether and 15 to 40% by weight of one or more condensation products of an alkylene oxide with an alcohol, thioalcohol or optionally alkyl substituted phenol or thiophenol and sufficient water to form a stable dispersion or solution; or 0.1 to 20 parts by weight of a compound of formula I, 0 to 20 parts by weight of urea, 0.2 to 40 parts by weight polyglycolether and sufficient water to form a solution.

* * * * *

UNITED STATES PATENT AND TRADEMARK OFFICE

CERTIFICATE OF CORRECTION

PATENT NO. : 4,169,702

DATED : October 2, 1979

INVENTOR(S) : Fritz Fleck/Emmanuel Hervot/Peter Merk/Horst Schmid/Achim Wiedemann It is certified that error appears in the above—identified patent and that said Letters Patent is hereby corrected as shown below:

Col. 12, claim 13, line 2; change "an" to --the--.

Col. 15, claim 22, line 2; delete "of (a)".

Col. 15, claim 23, line 2; delete "of (a) or (b)".

Signed and Sealed this

*Sixteenth* Day of *September 1980*

[SEAL]

*Attest:*

SIDNEY A. DIAMOND

*Attesting Officer*

*Commissioner of Patents and Trademarks*